United States Patent [19]

Haase et al.

[11] 4,169,032

[45] Sep. 25, 1979

[54] METHOD OF MAKING A THIN FILM THERMAL PRINT HEAD

[75] Inventors: Jerome B. Haase, Stewartville; James M. Thompson; Adrian M. Tobin, both of Rochester; William R. Wichmann, Elgin, all of Minn.

[73] Assignee: International Business Machines Corporation, Armonk, N.Y.

[21] Appl. No.: 909,316

[22] Filed: May 24, 1978

[51] Int. Cl.[2] ..... C23C 15/00

[52] U.S. Cl. ..... 204/192 F; 156/656; 219/216

[58] Field of Search ..... 204/192 C, 192 F, 192 SP, 204/192 D; 428/210, 336; 156/656; 427/126; 219/216; 346/76 R

[56] References Cited

U.S. PATENT DOCUMENTS

| | | | |
|---|---|---|---|
| 3,400,066 | 9/1968 | Caswell | 204/192 |
| 3,558,461 | 1/1971 | Parisi | 204/192 |
| 3,973,106 | 8/1976 | Ura | 219/216 |
| 4,105,892 | 8/1978 | Tashiro | 219/216 |

FOREIGN PATENT DOCUMENTS

| | | | |
|---|---|---|---|
| 48-14599 | 5/1973 | Japan | 204/192 F |

OTHER PUBLICATIONS

S. Shibata, et al., "New Type Thermal Printing Head," *IEEE Trans. on Parts, Hybrids, & Packaging*, vol. PHP-12, pp. 223-230, (1976).

*Primary Examiner*—Aaron Weisstuch
*Attorney, Agent, or Firm*—Robert W. Lahtinen

[57] ABSTRACT

A thin film thermal print head is fabricated using radio frequency (rf) or direct current (DC) sputtering within a vacuum chamber into which is introduced a partial pressure of argon and nitrogen. Without breaking the vacuum, three consecutive layers comprising respectively tantalum nitride, gold, and tantalum nitride are sputter deposited and a diffusion barrier formed on a glazed substrate material. After these steps the desired land patterns are formed by photo lithographic techniques and chemical etching and finally sealant and abrasion resistant coatings are applied.

5 Claims, 2 Drawing Figures

METHOD OF MAKING A THIN FILM THERMAL PRINT HEAD

DESCRIPTION

BACKGROUND OF THE INVENTION

This invention relates to thermal print heads and more particularly to an improved thin film thermal print head.

Various prior art thermal print head devices are known including those made using thin film fabricating techniques. Thin film devices offer the advantage of small mass that permits both rapid temperature elevation and a short duration at the elevated temperature and accordingly thin film devices are readily adaptable to the higher speed operation presently sought in the printing art. The thin film techniques, however, are inherently costly and consequently any device or technique that reduces the expense of fabrication as well as those procedures that result in an improved product are commercially important in rendering the devices so made competitively attractive with regard to those using other fabricating techniques and materials.

SUMMARY OF THE INVENTION

In the thin film technique of the present invention a glazed ceramic substrate is placed in an evacuation chamber, the chamber evacuated and partial pressures of argon and nitrogen selectively introduced. During the single evacuation, without breaking the vacuum, three layers are applied to the glazed surface by rf or DC sputtering techniques and a diffusion barrier is formed. The first layer is 250 to 1,000 angstroms of tantalum nitride. Following the deposition of this layer, processing is interrupted for a period of ten minutes to permit an oxy-nitride diffusion barrier to form at the surface of the tantalum nitride. Thereafter successive layers of a stable conductor (gold) and a bonding layer (tantalum nitride) to affect adhesion of subsequent coatings to the gold are applied to the glazed substrate surface. Following the deposition of these three layers, a predetermined land pattern of conductors and thermal print resistive elements is formed using photo lithographic and chemical etching techniques. After the selective etching of the three sputtered layers an abrasion resistant coating is applied over the land pattern which may also be preceded by a sealant coating. These last coatings normally cover the entire surface with the exception of exposed conductor portions to be used as terminal connections.

DETAILED DESCRIPTION

Figure 1:
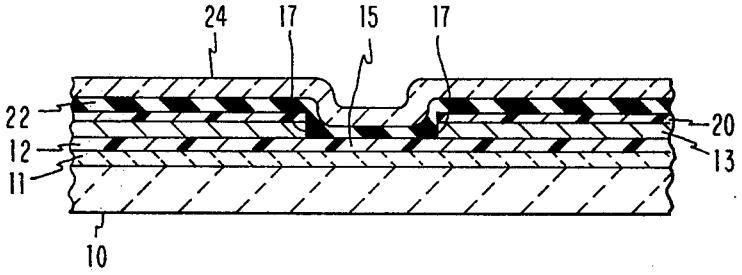
FIG. 1 is an enlarged sectional representation of a module as formed by the present invention showing a section through a conductor and a thermal print location where the metalic conductor is interrupted.

As shown in the sectional view of FIG. 1, the head structure includes a ceramic base or substrate 10 having a glazed surface 11. A tantalum nitride layer 12 is formed selectively on the glazed ceramic surface. A barrier layer of oxy-nitride overlies the tantalum nitride to prevent the diffusion of the gold 13 overlying the tantalum nitride 12 into such underlying tantalum nitride layer. The gold layer 13 forms a pattern of highly conductive paths which are selectively interrupted to form the thermal printing resistance heating element 15 where the current is required to flow through the highly resistive tantalum nitride between the ends 17 of the gold conductor material. The gold is sputtered onto the underlying tantalum nitride layer to a thickness of 10,000 angstroms. Because gold is too passive to form a good bond with silicon dioxide, a second tantalum nitride layer 20 is applied thereon to permit a better bond to be established with the subsequent protective abrasion resistant coatings. A protective coating is formed of a silicon dioxide layer 22 and a tantalum oxide layer 24. These passivating and wear resistant coatings are not always stoichiometric. The silicon dioxide 22 prevents oxidation of the tantalum nitride heating resistor 15 which must be powered repeatedly to achieve a high temperature in excess of 200° celcius and typically in the range of 300° to 400° celcius during print operation. The final coating 24 of tantalum oxide affords abrasion resistance as the circuit rubs directly against the heat sensitive paper.

Figure 2:
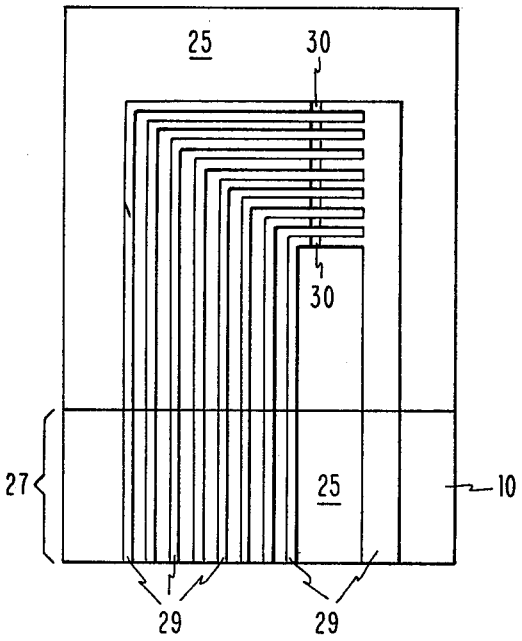
FIG. 2 is an enlarged plan view of a thermal print module in accordance with the present invention.

The print head as shown in FIG. 2 is fabricated by placing the glazed ceramic substrate 10 in a vacuum chamber and applying tantalum nitride and gold layers by rf or DC diode bias sputtering. The vacuum chamber is evacuated to approximately $1\times10^{-6}$ Torr background pressure. The atmosphere within the chamber is controlled to contain $1\times10^{-2}$ Torr argon and from $10^{-4}$ to $5\times10^{-4}$ Torr nitrogen with $1\times10^{-6}$ atmosphere of residual gas. During the sputtering operation a bias of 50 to 200 volts is normally applied to the substrate to avoid the incorporation of impurities. The two tantalum nitride layers and the gold layer are then sputtered without breaking vacuum. Argon and nitrogen are introduced during the sputtering of the tantalum nitride, but only argon is introduced while sputtering the gold layer. The first sputtering step applies a 200 to 1,000 angstrom coating of tantalum nitride following which there is a ten minute pause before sputtering the gold layer. During this pause an oxy-nitride diffusion barrier film is developed at the surface of the tantalum nitride layer from the nitrogen content of the gas forming the partial pressure and oxygen in the residual atmosphere within the chamber. The diffusion barrier prevents the subsequent gold layer from compromising resistive qualities of the underlying tantalum nitride and makes unnecessary the application of a nickel-chromium alloy barrier layer by an additional fabrication step prior to the application of the gold conductor material. Thereafter a layer of gold having a thickness of 1,000 to 10,000 angstrom is sputtered onto the tantalum nitride layer over the oxy-nitride diffusion barrier film and another tantalum nitride layer is rf or DC sputtered over the gold. Following these procedures the coated substrate is removed from the vacuum chamber.

Using photo lithographic technology and chemical etching techniques the gold and tantalum nitride layers are selectively etched to form the desired land patterns on the substrate. All three layers are removed, as for example surfaces 25 of FIG. 2, to form the desired land patterns. In the terminal area defined by the bracket 27 the upper tantalum nitride layer 20 is removed to expose metalic gold conductor to form terminals 29 for connection to leads extending off the substrate. In those areas where tantalum nitride resistors are to be active to form print elements 30 that effect the thermal printing, both the upper tantalum nitride layer 20 and the gold layer 13 are removed to cause a current flow through the lower tantalum nitride layer 12 between the interrupted ends 17 of the metalic gold conductor.

Following the selective etching to form the land pattern, the entire surface with the exception of the terminal area 27 is coated first with silicon dioxide and thereafter with tantalum oxide. These final coatings are applied by radio frequency sputtering since the dielectric qualities of both the silicon dioxide and tantalum oxide preclude the use of DC sputtering.

While a preferred embodiment of the invention has been illustrated and described, it is to be understood that various changes in form and details may be made therein without departing from the spirit and scope of the invention as defined in the appended claims.

Having described our invention, what we claim as new and desire to secure by Letters Patent is:

1. A method of forming a thermal printing device comprising placing a glazed ceramic substrate in a chamber; evacuating said chamber and thereafter introducing into said chamber a partial pressure of argon and nitrogen; sputtering a layer of tantalum nitride onto the glazed surface of said ceramic substrate; allowing said tantalum nitride coated glazed ceramic substrate to remain in said partial pressure of argon and nitrogen for a discrete period of time to permit an oxy-nitride diffusion barrier to form at the surface of said tantalum nitride; and applying a stable conductive material over the oxy-nitride film by sputtering in said chamber without opening said chamber to the atmosphere.

2. The method of forming a thermal printing device of claim 1 further comprising applying a layer of tantalum nitride over said stable conductive material by sputtering without opening said chamber to the atmosphere, whereby during a single evacuation of said chamber the tantalum nitride, diffusion barrier, stable conductive material and tantalum nitride layers respectively are applied to said ceramic substrate.

3. The method of forming a thermal printing device of claim 2 wherein said step of applying a stable conductive material comprises the sputtering of metallic gold over said oxy-nitride diffusion barrier.

4. The method of forming a thermal printing device of claim 3 further comprising the steps of selectively etching said layer using photo lithographic techniques and chemical etching to form a predetermined land pattern including thermal print resistance elements and coating at least a portion of the land pattern with an abrasion resistant coating, said portion including said thermal print resistant element.

5. The method of forming the thermal printing device of claim 4 wherein said coating step includes applying a first coating of sealing material and subsequently applying a second coating of abrasion resisting material.

* * * * *